US010797410B2

(12) United States Patent
Hata

(10) Patent No.: US 10,797,410 B2
(45) Date of Patent: Oct. 6, 2020

(54) CONNECTOR

(71) Applicant: KYOCERA Corporation, Kyoto (JP)

(72) Inventor: Tetsuya Hata, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 16/478,547

(22) PCT Filed: Mar. 2, 2018

(86) PCT No.: PCT/JP2018/007948
§ 371 (c)(1),
(2) Date: Jul. 17, 2019

(87) PCT Pub. No.: WO2018/173686
PCT Pub. Date: Sep. 27, 2018

(65) Prior Publication Data

US 2020/0052418 A1 Feb. 13, 2020

(30) Foreign Application Priority Data

Mar. 22, 2017 (JP) ..... 2017-056632

(51) Int. Cl.
*H01R 4/24* (2018.01)
*H01R 4/2433* (2018.01)

(52) U.S. Cl.
CPC ..... *H01R 4/2433* (2013.01)

(58) Field of Classification Search
CPC ..... H01R 4/2433; H01R 4/70; G02B 6/3857; H02G 15/18; H02G 15/046; H02G 15/003
USPC ..... 439/395
See application file for complete search history.

(56) References Cited

U.S. PATENT DOCUMENTS 3,804,971 A * 4/1974 Bazille, Jr. ..... H01R 4/2433 174/88 R
3,992,569 A * 11/1976 Hankins ..... H02G 15/003 174/92
5,198,619 A * 3/1993 Baker ..... H02G 15/046 174/74 A
5,397,859 A * 3/1995 Robertson ..... H01R 4/70 174/92
5,714,717 A * 2/1998 Nakagome ..... H01R 4/2433 174/91

(Continued)

FOREIGN PATENT DOCUMENTS

CN 1099511 A 3/1995
JP H11-204192 A 7/1999
JP 3028988 B2 4/2000

(Continued)

*Primary Examiner* — Jean F Duverne
(74) *Attorney, Agent, or Firm* — Studebaker & Brackett PC

(57) ABSTRACT

Provided is a connector configured to prevent a filler and a contact from contacting an external component even during work or transportation. A connector (10) according to this disclosure includes a first fitting object (16) and a second fitting object (30) fitted together; a filler (70) provided in at least one of the first fitting object (16) and the second fitting object (30); and a contact (50) included in at least one of the first fitting object (16) and the second fitting object (30). The filler (70) and the contact (50) are located, in a corresponding fitting object, inside of a top end of a fitting side of the fitting object, in a state before the first fitting object (16) and the second fitting object (30) are fitted together.

8 Claims, 11 Drawing Sheets

(56) References Cited

U.S. PATENT DOCUMENTS

| | | | | |
|---|---|---|---|---|
| 6,111,201 | A * | 8/2000 | Drane | H02G 15/18 174/92 |
| 10,191,225 | B2 * | 1/2019 | Kudo | G02B 6/3857 |

FOREIGN PATENT DOCUMENTS

| | | | |
|---|---|---|---|
| JP | 2012-221812 | A | 11/2012 |
| JP | 2016189329 | A | 11/2016 |
| WO | 2012142011 | A1 | 10/2012 |

* cited by examiner

CONNECTOR

CROSS REFERENCE TO RELATED APPLICATION

This application claims priority to and the benefit of Japanese Patent Application No. 2017-056632 filed on Mar. 22, 2017, the entire contents of which are incorporated herein by reference.

TECHNICAL FIELD

This disclosure relates to a connector.

BACKGROUND

In a conventionally known connector, a filler is placed in each of a pair of fitting objects to be fitted together to protect a contacting portion of a corresponding contact from foreign matter such as water or dust entering from outside when the objects are fitted together.

For example, Patent Literature 1 (PTL 1) discloses a connector in which a drip-proof configuration is obtained by bringing a pair of elastic annular members of a grommet into close contact with each other when a cover and a body are fitted together.

CITATION LIST

Patent Literature

PTL 1: JP3028988 (B2)

SUMMARY

Technical Problem

However, when a filler is placed in each of a pair of fitting objects before being fitted together, and a contact is provided in one of the fitting objects, the filler or the contact may contact an external component or foreign matter during work or transportation, and as a result properties of the filler may change or the contact may be damaged. Further, the external component may be damaged when contacting the contact.

It is therefore an object of this disclosure to provide a connector configured to prevent a filler and a contact from contacting an external component even during work or transportation.

Solution to Problem

In order to solve the above problem, a connector according to a first aspect includes:

a pair of a first fitting object and a second fitting object capable of being fitted together;

a filler provided in at least one of the first fitting object and the second fitting object; and a contact provided to at least one of the first fitting object and the second fitting object, wherein the filler and the contact are located, in a corresponding fitting object, inside of a top end of a fitting side of the fitting object in a state before the first fitting object and the second fitting object are fitted together.

In the connector according to a second aspect, the filler may be located, in the at least one of fitting objects, inside of an end surface of a fitting side of an outer peripheral wall.

In the connector according to a third aspect, the filler is provided in each of the first fitting object and the second fitting object, and may be located, in each of the first fitting object and the second fitting object, inside of the end surface of the fitting side of the outer peripheral wall.

In the connector according to a fourth aspect, the first fitting object and the second fitting object are connected to each other by a connecting portion; the first fitting object or the second fitting object includes the contact having an electrically connecting portion; the first fitting object or the second fitting object holds a cable; and the contact may be included with electrically connected with the cable in a state in which the first fitting object and the second fitting object are fitted together.

In the connector according to a fifth aspect, the at least one cable may extend outward from the contact arranged inside of the filler when fitted together.

In the connector according to a sixth aspect, the electrically connecting portion is a press-contact groove; the first fitting object or the second fitting object holds at least two of the cables; and the contact may clamp core wires of the cables by the press-contact groove to electrically connect the cables to each other when the first fitting object and the second fitting object are fitted together.

In the connector according to a seventh aspect, a top end surface of a fitting side of one of the first fitting object and the second fitting object and a surface of the connecting portion are arranged on the same plane; and the other one of the fitting objects may protrude in a direction opposite the one of the fitting objects with respect to the plane.

Advantageous Effect

According to an embodiment of this disclosure, a connector configured to prevent a filler and a contact from contacting an external component even during work or transportation can be provided.

DETAILED DESCRIPTION

An embodiment of this disclosure will be described below with reference to the accompanying drawings. In the following description, a front-rear direction, a right-left direction and an up-down direction are based on the directions of the arrows in the figures.

The configuration of a connector 10 loaded with no filler 70 will be mainly described.

Figure 1:
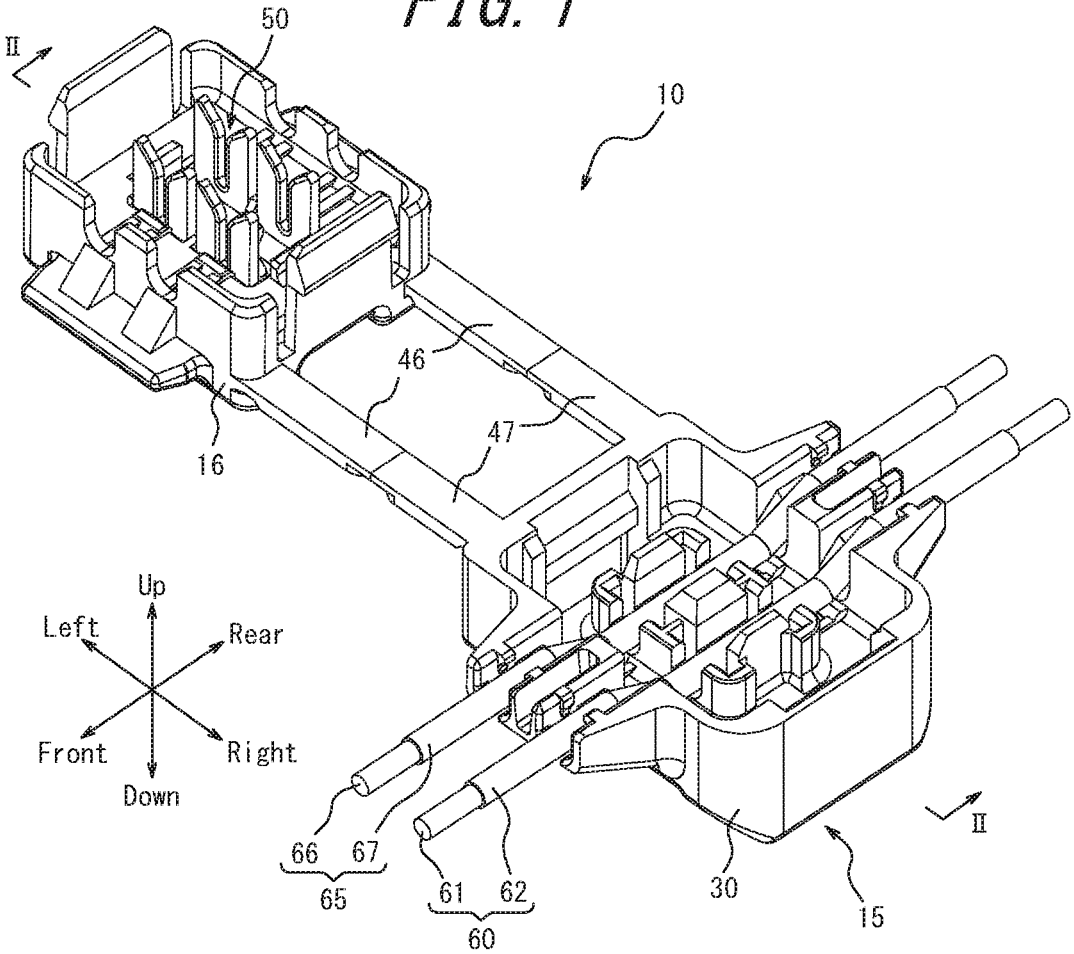
FIG. 1 is a perspective view of a connector, a first cable and a second cable according to an embodiment of this disclosure in which an insulating housing is in an expanded state.
Figure 2:
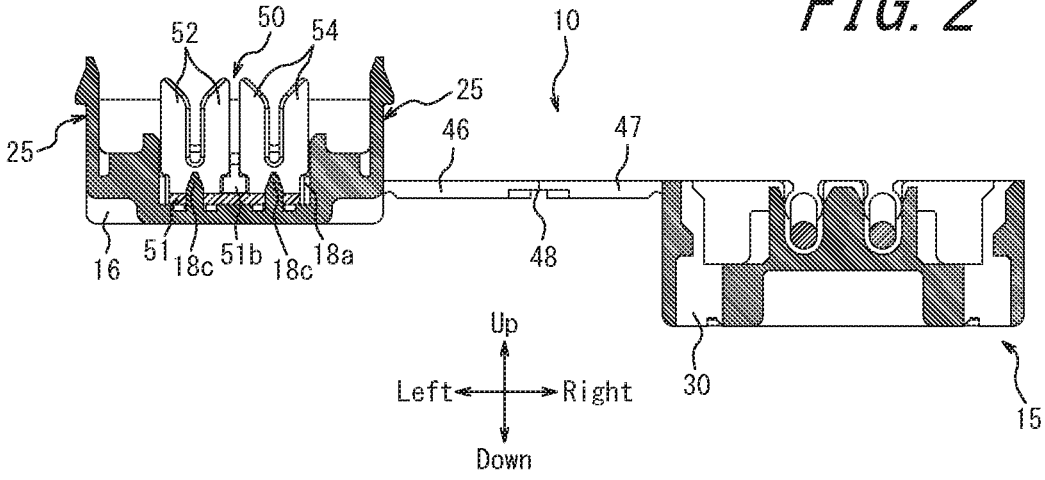
FIG. 2 is a cross-sectional view taken along arrows II-II of FIG. 1.

FIG. 1 is a perspective view of a connector 10, a first cable 60 and a second cable 65 according to an embodiment of this disclosure in which an insulating housing 15 is in an expanded state. FIG. 2 is a cross-sectional view taken along arrows II-II of FIG. 1. The connector 10 of an embodiment includes the insulating housing 15 and a relay contact 50 (contact) as main elements.

The insulating housing 15 is obtained by, for example, molding a synthetic resin material having an insulating property. The insulating housing 15 includes a first split housing 16 (first fitting object) and a second split housing 30 (second fitting object). The insulating housing 15 includes a first connecting portion 46 and a second connecting portion 47 (connecting portion) serving as a coupling portion connecting the first split housing 16 and the second split housing 30. The insulating housing 15 includes the first split housing 16 and the second split housing 30, and the first connecting portion 46 and the second connecting portion 47, in an integrally molded manner.

The relay contact 50 is provided in the first split housing 16, for example. As illustrated in FIG. 2, the relay contact 50 is located, in a corresponding first split housing 16, inside of an upper end (a top end of a fitting side) of the first split housing 16 in a state before the first split housing 16 and the second split housing 30 are fitted together. For example, the relay contact 50 is located inside of each top end of first locking portions 25 of the first split housing 16 described below. In other words, the upper end of the relay contact 50 is located lower than each upper end of the first locking portions 25.

Figure 3:
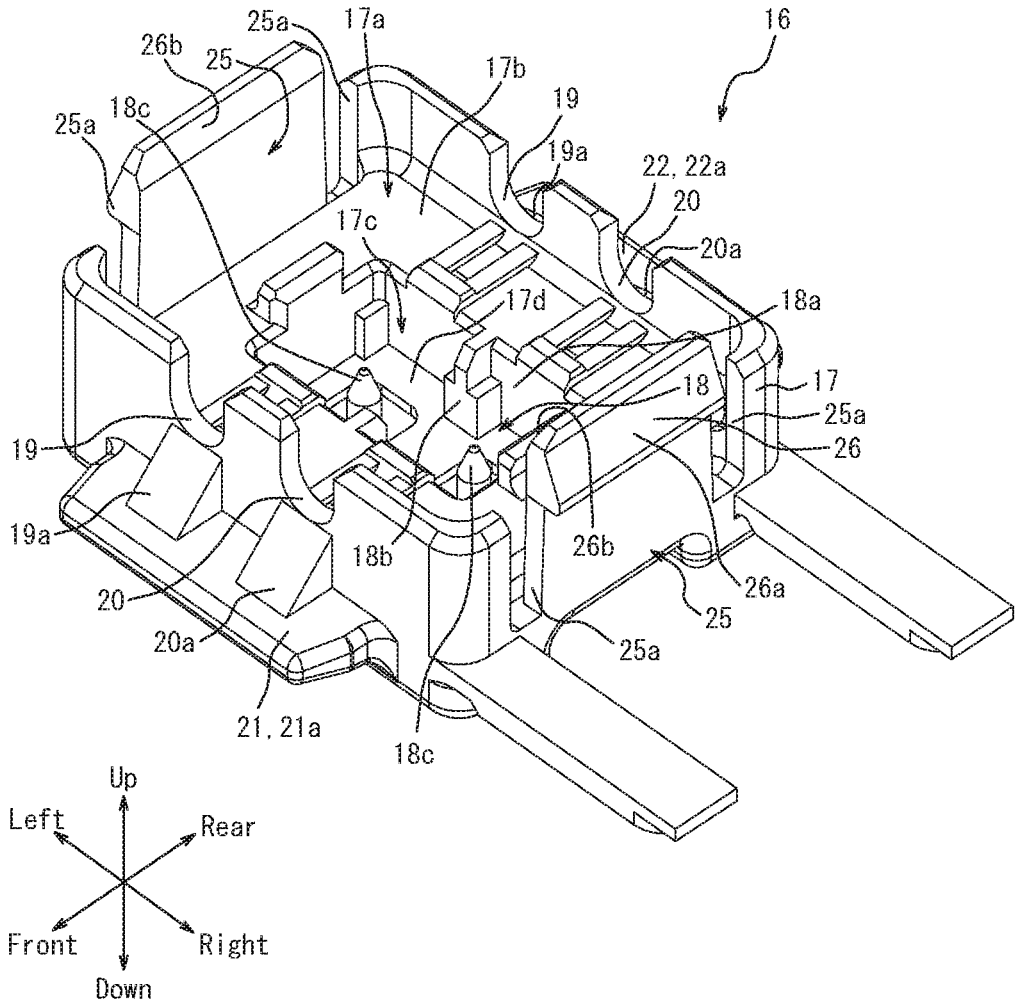
FIG. 3 is an enlarged perspective view illustrating a first split housing alone, omitting a relay contact.

FIG. 3 is an enlarged perspective view illustrating the first split housing 16 alone, omitting the relay contact 50. The configuration of the first split housing 16 will be described in detail with reference to FIG. 3.

An outer peripheral edge of one surface (an upper surface in FIG. 3) in a thickness-direction of the first split housing 16 is formed by an outer peripheral wall 17. In the first split housing 16, the inside of the outer peripheral wall 17 is configured as an inner peripheral recess 17*a* recessed stepwise from the top surface of the first split housing 16. The bottom surface of the inner peripheral recess 17*a* includes an inner peripheral first opposing surface 17*b* configured as a plane parallel to the top surface of the first split housing 16. The central portion located on the inner peripheral side of the inner peripheral first opposing surface 17*b* is configured as a first central recess 17*c* recessed stepwise from the inner peripheral first opposing surface 17*b*. The bottom surface of the first central recess 17*c* includes a first central opposing surface 17*d* configured as a plane parallel to the inner peripheral first opposing surface 17*b*. The first central recess 17*c* and the first central opposing surface 17*d* constitute a contact mounting groove 18. The contact mounting groove 18 includes a fixing portion 18*a* and a central projection 18*b*, which is located at the center of the fixing portion 18*a* with respect to the right-left direction and configured to narrow the front-rear direction width of the fixing portion 18*a* while separating the fixing portion 18*a* into a pair of portions in the right-left direction. Each of the bottom surfaces of the fixing portion 18*a* (the first central opposing surface 17*d*) is provided with a positioning protrusion 18*c* having a substantially cylindrical shape.

The outer peripheral wall 17 of the first split housing 16 includes a pair of first cable mounting grooves 19 configured as cutouts linearly arranged on the front and rear sides of one of the fixing portions 18*a*. The outer peripheral wall 17 of the first split housing 16 also includes a pair of second cable mounting grooves 20 configured as cutouts linearly arranged on the front and rear sides of the other fixing portion 18*a*. The second cable mounting groove 20 is in parallel with the first cable mounting groove 19. Each of the first cable mounting grooves 19 and each of the second cable mounting grooves 20 have a semi-circular shape in a plan view. On the front and rear surfaces of the outer peripheral wall 17 of the first split housing 16, a pair of inclined surfaces 19*a* is provided inclining outward in the downward direction from the bottoms of the pair of first cable mounting grooves 19. Similarly, on the front and rear surfaces of the outer peripheral wall 17 of the first split housing 16, a pair of inclined surfaces 20*a* is provided inclining outward in the downward direction from the bottoms of the pair of second cable mounting grooves 20. The front and rear surfaces of the outer peripheral wall 17 of the first split housing 16 are provided with cover portions 21 and 22, respectively. The cover portion 21 has a flat-plate shape extending in the front direction from under the inclined surfaces 19*a* and 20*a*, and the cover portion 22 has a flat-plate shape extending in the rear direction from under the inclined surfaces 19*a* and 20*a*. The opposing surface 21*a* of the cover portion 21 and the opposing surface 22*a* of the cover portion 22 are flush with the bottom of the inclined surface 19*a* and the inclined surface 20*a*.

The right and left side surfaces of the outer peripheral wall 17 of the first split housing 16 are provided with a pair of first locking portions 25 having resiliency. A pair of recesses 25*a* is formed between each first locking portion 25 and the front and rear surfaces of the outer peripheral wall 17. Each first locking portion 25 is provided with a first locking protrusion 26 that protrudes outward from the side surface of the first split housing 16. The first locking protrusions 26 extend in the front-rear direction. Each first locking protrusion 26 includes an inclined surface 26*a* that is inclined to the outside of the first split housing 16 in the downward direction. Each of the pair of first locking portions 25 is provided with an inclined surface 26*b* that is formed on the top edge of the inner surface of each of the pair of first locking portions 25 and inclined to the inside of the first split housing 16 in the downward direction.

Figure 4:
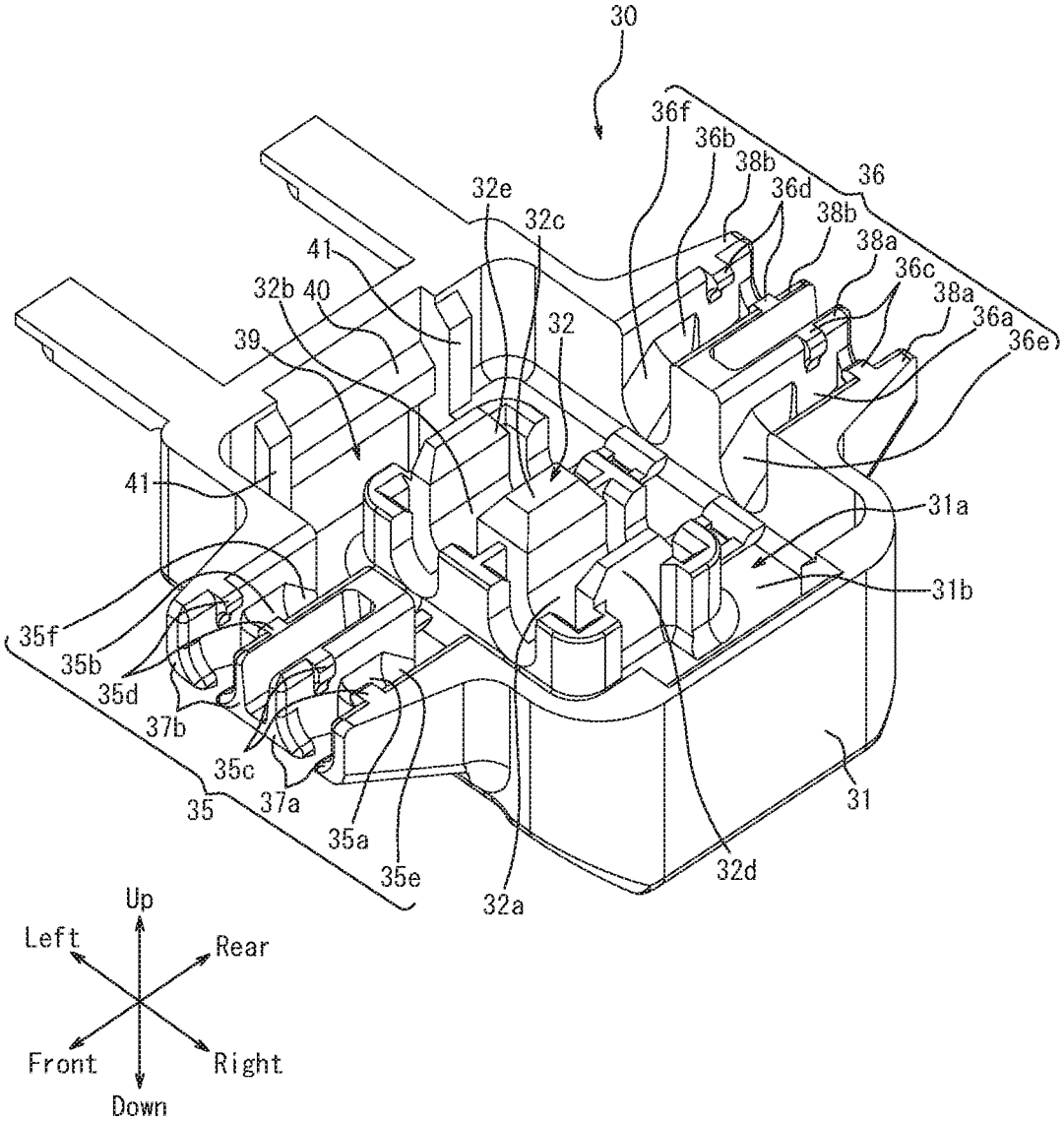
FIG. 4 is an enlarged perspective view illustrating a second split housing alone.

FIG. 4 is an enlarged perspective view of the second split housing 30 alone. The configuration of the second split housing 30 will be described in detail with reference to FIG. 4.

An outer peripheral edge of one surface (an upper surface in FIG. 4) in a thickness-direction of the second split housing 30 is formed as a protrusion by an outer peripheral wall 31. In the second split housing 30, the inside of the outer peripheral wall 31 is configured as an inner peripheral recess 31*a* that is recessed stepwise from the top edge of the outer peripheral wall 31. A bottom surface of the inner peripheral recess 31*a* includes an inner peripheral second opposing surface 31*b* configured as a flat plane parallel to the top surface of the second split housing 30. The inner peripheral second opposing surface 31*b* is provided with a cable pressing protrusion 32 that includes a pair of a first pressing groove 32*a* and a second pressing groove 32*b* having U-shapes in cross-sections arranged in the right-left direction. The cable pressing protrusion 32 includes a central protrusion 32*c* and protrusions 32*d* and 32*e* on the right side and the left side, respectively, of the central protrusion 32*c*. The first pressing groove 32*a* is formed between the central protrusion 32*c* and the protrusion 32*d*. The second pressing groove 32*b* is formed between the central protrusion 32*c* and the protrusion 32*e*.

The second split housing 30 includes a cable supporting arm 35 protruding from the front surface of the second split housing 30 and a cable supporting arm 36 protruding from the rear surface. The top surface of the cable supporting arm 35 includes a first cable holding groove 35*a* and a second cable holding groove 35*b*, and the top surface of the cable supporting arm 36 includes a first cable holding groove 36*a* and a second cable holding groove 36*b*. The cable supporting arm 35 located on the front side is provided with a pair of protruding members 37*a* spaced apart from each other in the right-left direction in the front end portion of the first cable holding groove 35*a*, and the cable supporting arm 36 located on the rear side is provided with a pair of protruding members 38*a* spaced apart from each another in the right-left direction in the rear end portion of the first cable holding groove 36*a*. Similarly, the cable supporting arm 35 located on the front side is provided with a pair of protruding members 37*b* spaced apart from each other in the right-left direction in the front end portion of the second cable holding groove 35*b*, and the cable supporting arm 36 located on the rear side is provided with a pair of protruding members 38*b* spaced apart from each other in the right-left direction in the rear end portion of the second cable holding groove 36*b*. Each of the pair of protruding members 37*a*, the pair of protruding members 38*a*, the pair of protruding members 37*b* and the pair of protruding members 38*b*, particularly those located on the right and left outer sides of the cable supporting arms 35 and 36, is elastically bent in the right-left direction and the spacing from its adjacent protrusion is changeable. Each of the pair of protruding members 37*a* and 37*b* includes a pair of claws opposing each other formed at the lower front end. Also, each of the pair of protruding members 38*a* and 38*b* includes a pair of claws opposing each other formed at the lower rear end.

Each of the first cable holding grooves 35*a* and 36*a* and each of the second cable holding grooves 35*b* and 36*b* has a depth sufficient for insertion and retention (to accommodate) of the entire diameter of the first cable 60 and the second cable 65. The first cable holding grooves 35*a* and 36*a* include inclined surfaces 35*e* and 36*e*, respectively, which are inclined upward in the outward directions. That is, when the first cable 60 is inserted into and held by the first cable holding grooves 35*a* and 36*a*, portions of the first cable 60 corresponding to the inclined surface 35*e* of the first cable holding groove 35*a* and the inclined surface 36*e* of the first cable holding groove 36*b* are inclined obliquely in the up-down direction along the inclined surfaces. Similarly, the second cable holding grooves 35*b* and 36*b* include inclined surfaces 35*f* and 36*f*, respectively. The second cable 65 is inserted into and held by the second cable holding grooves 35*b* and 36*b* in a manner similar to the first cable 60.

A pair of retainer protrusions 35*c* is provided to the first cable holding groove 35*a* in the vicinity of a top opening of a front end portion (on the opposing surfaces provided with the pair of protruding members 37*a*) and a pair of retainer protrusions 36*c* is provided to the first cable holding groove 36*a* in the vicinity of a top opening of a rear end portion (on the opposing surfaces provided with the pair of protruding members 38*a*). Similarly, a pair of retainer protrusions 35*d* is provided to the second cable holding groove 35*b* in the vicinity of a top opening of a front end portion (on the opposing surfaces provided with the pair of protruding members 37*b*), and a pair of retainer protrusions 36*d* is provided to the second cable holding groove 36*d* in the vicinity of a top opening of a rear end portion (on the opposing surfaces provided with the pair of protruding members 38*b*). The retainer protrusions 35*c* and 36*c* allow insertion of the first cable 60 into the first cable holding grooves 35*a* and 36*a*, and the retainer protrusions 35*d* and 36*d* allow insertion of the second cable 65 into the second cable holding grooves 35*b* and 36*b*. At the time of the insertion, each of the pair of protruding members 37*a*, the pair of protruding members 38*a*, the pair of protruding members 37*b* and the pair of protruding members 38*b* is bent such that the gaps therebetween (i.e., the gap between the pair of retainer protrusions 35*c*, the gap between the pair of retainer protrusions 36*c*, the gap between the pair of retainer protrusions 35*d*, and the gap between the pair of retainer protrusions 36*d*) are widened in the right-left direction.

When the first cable 60 and the second cable 65 are inserted into the first cable holding grooves 35*a* and 36*a* and the second cable holding grooves 35*b* and 36*b*, respectively, each of the pair of retainer protrusions 35*c* and the pair of retainer protrusions 36*c* clamp the first cable 60, and each of the pair of retainer protrusions 35*d* and the pair of retainer protrusions 36*d* clamp the second cable 65. Each of the pair of protruding members 37*a*, the pair of protruding members 38*a*, the pair of protruding members 37*b* and the pair of protruding members 38*b* is elastically bent in directions which narrow the space therebetween in the right-left direction. Thus, the pair of protruding members 37*a* and the pair of protruding members 38*a* allow, in a resisting manner, a cable-extending-direction movement of the first cable 60 inserted into the first cable holding grooves 35*a* and 36*a*. Also, the pair of protruding members 37*b* and the pair of protruding members 38*b* allow, in a resisting manner, a cable-extending-direction movement of the second cable 65 inserted into the second cable holding grooves 35*b* and 36*b*. Further, the pair of protruding members 37*a* and the pair of protruding members 38*a* function as a stopper configured to resist a force acting to remove the first cable 60 from the first cable holding grooves 35*a* and 36*a* and inhibit easy removal of the first cable 60, and allow removal of the first cable 60 upon application of an external force of a certain strength or greater. Also, the pair of protruding members 37*b* and the pair of protruding members 38*b* function as a stopper configured to resist a force acting to remove the second cable 65 from the second cable holding grooves 35*b* and 36*b* and inhibit easy removal of the second cable 65, and allow removal of the second cable 65 upon application of an external force of a certain strength or greater. Such retaining actions as described above are maintained even when the second split housing 30 is flipped over (interchange of inside and outside).

The right and left side surfaces of the outer peripheral wall 31 of the second split housing 30 include a pair of second locking portions 39. The pair of second locking portions 39 is formed on the inner surface of the second split housing 30. Each of the pair of second locking portions 39 includes a second locking protrusion 40 that protrudes inward from the side surface of the second split housing 30. Each of the second locking portions 39 includes a pair of projection walls 41 extending in the up-down direction at the front and rear ends of the respective second locking portions 39. Each of the second locking protrusions 40 has a substantially rectangular parallelepiped shape formed on the inner surface of the second split housing 30 and extends between the pair of projection walls 41. That is, the second locking protrusions 40 extend in the front-rear direction.

Figure 5:
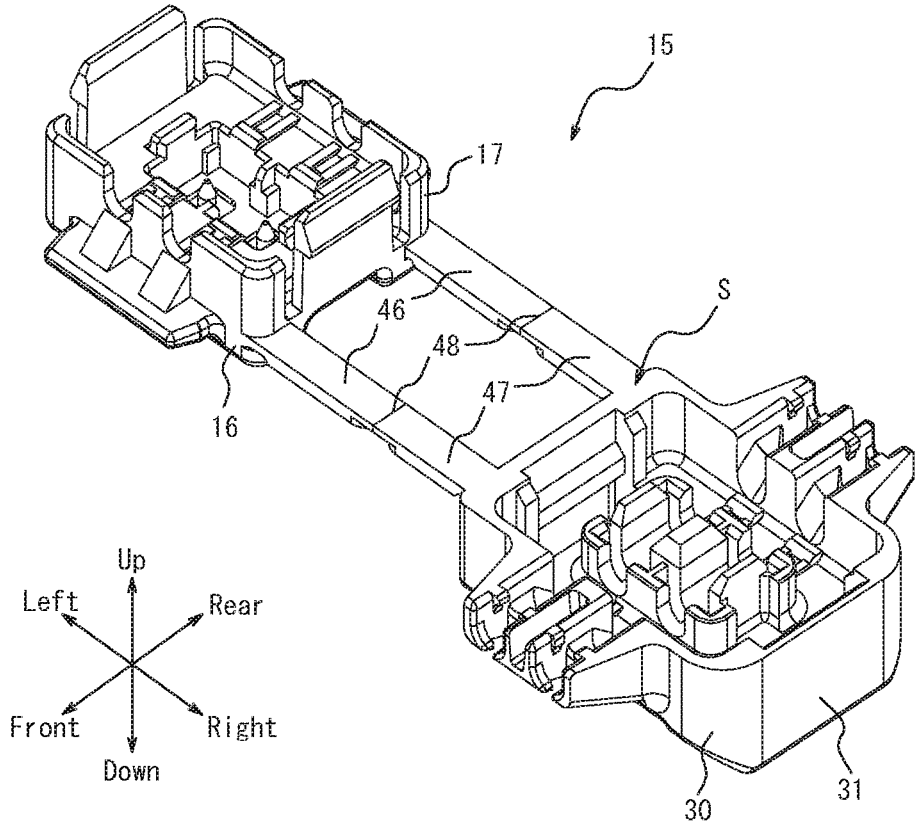
FIG. 5 is a perspective view illustrating the insulating housing in its entirety, omitting the relay contact.

FIG. 5 is a perspective view illustrating the insulating housing 15 in its entirety, omitting the relay contact 50.

The first split housing 16 and the second split housing 30 are coupled via the pair of first connecting portions 46 that is arranged in the front-rear direction and linearly extends from the first split housing 16, a pair of second connecting portions 47 that is arranged in the front-rear direction and linearly extends from the second split housing 30, and a pair of fold-facilitating portions 48. The fold-facilitating portions 48 couple the pair of first connecting portions 46 and the pair of second connecting portions 47. The pair of first connecting portions 46 and the pair of second connecting portions 47 are flushed with each other in the expanded state.

The fold-facilitating portions 48 are thinner than the first connecting portion 46 and the second connecting portion 47 arranged in the front-rear direction, as illustrated in FIG. 2 and FIG. 5. Each of the pair of first connecting portions 46 and the pair of second connecting portions 47 arranged in the front-rear direction can be (easily) folded at the fold-facilitating portions 48 that extend in the front-rear direction and serve as a folding line for valley-folding (i.e., in a folding manner to bring the first split housing 16 and the second split housing 30 close to each other) in FIG. 1, FIG. 5, and the like. The pair of first connecting portions 46 has flexural rigidity smaller than that of the pair of second connecting portions 47.

Each of the first split housing 16, the pair of first connecting portions 46, the fold-facilitating portions 48, the pair of second connecting portions 47, and the second split housing 30 has strength (rigidity) sufficient to autonomously maintain the expanded state illustrated in FIG. 1 and FIG. 5.

In FIG. 5, the top surface of the second split housing 30 (the top end surface of the fitting side) and the surfaces, in particular the top surfaces, of the first connecting portions 46 and the second connecting portions 47 form a flush plane S. The first split housing 16 protrudes opposite the second split housing 30 with respect to the top surfaces of the first connecting portions 46 and the second connecting portions 47. The first split housing 16 protrudes upward with respect to the plane S, and the second split housing 30 protrudes downward with respect to the plane S. In particular, the outer peripheral wall 17 of the first split housing 16 and the outer peripheral wall 31 of the second split housing 30 protrude in opposite directions such as upward and downward, respectively, with respect to the plane S.

Figure 6:
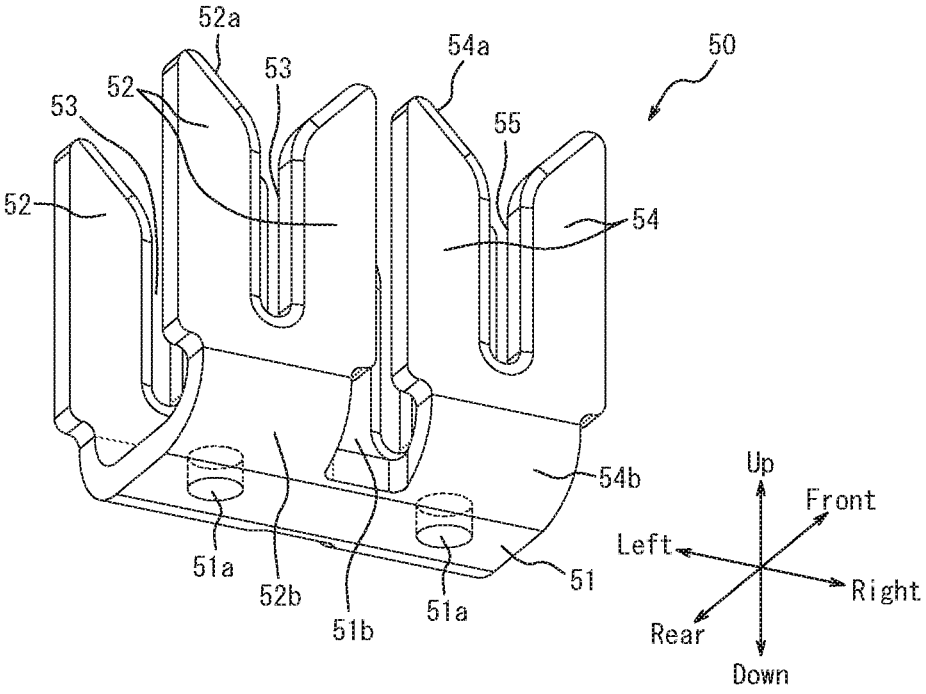
FIG. 6 is a perspective view illustrating the relay contact alone.

FIG. 6 is a perspective view illustrating the relay contact 50 alone. A configuration of the relay contact 50 will be described in detail with reference to FIG. 6.

The relay contact 50 is formed by processing of a thin plate made of a copper alloy (e.g., phosphor bronze, beryllium copper, or titanium copper) or Corson copper alloy into a shape as illustrated in the figure by using a progressive die (stamping). The relay contact 50 is plated with copper-tin alloy or tin (or gold) after nickel plate undercoating.

The relay contact 50 includes, in an integrated manner, a base 51 that has a plate-like shape and extends in the right-left direction, a pair of first cable press-contact members 52 each having a plate-like shape that protrudes from the front and rear edges on one side of the base 51 and extends in a direction perpendicular to the base 51, and a pair of second cable press-contact members 54 each having a plate-like shape that protrudes from the front and rear edges on the other side of the base 51 and extends in a direction perpendicular to the base 51. The base 51 includes a pair of positioning holes 51*a* having a circular shape in the right and left portions of the base 51. Each of the pair of first cable press-contact members 52 and each of the pair of second cable press-contact members 54 arranged in the front-rear direction includes a first press-contact groove 53 and a second press-contact groove 55, respectively, configured as slits linearly extending toward the base 51. Each of the pair of first press-contact grooves 53 includes, at the top opening thereof, a top end portion 52*a* having a substantially V-shape opening upward. Each of the pair of second press-contact grooves 55 includes, at the top opening thereof, a top end portion 54*a* having a substantially V-shape opening upward.

The pair of first cable press-contact members 52 and the pair of second cable press-contact members 54 arranged in the front-rear direction are coupled to the base 51 via narrow portions (neck portions) 52*b* and 54*b*, respectively. The spaces between the opposing edges of the pair of first cable press-contact members 52 and the pair of second cable press-contact members 54 arranged in the right-left direction are narrower than the spaces between the opposing edges of the narrow portions 52*b* and the narrow portions 54*b*. A space 51*b* is formed between the narrow portion 52*b* and the narrow portion 54*b*. No other members, such as an insulator, are provided between the pair of first cable press-contact members 52 and the pair of second cable press-contact members 54.

The relay contact 50 is included with electrically connected with the first cable 60 and the second cable 65 in a state in which the first split housing 16 and the second split housing 30 are fitted together. When the first split housing 16 and the second split housing 30 are fitted together, the relay contact 50 cuts insulating sheaths 62 and 67 by a first press-contact groove 53 and a second press-contact groove 55, respectively, to allow the first cable 60 and the second cable 65 to be electrically connected to each other. When fitted together, the relay contact 50 allows the first press-contact groove 53 and the second press-contact groove 55 to clamp a core wire 61 and a core wire 66, respectively, to allow the first cable 60 and the second cable 65 to be electrically connected to each other.

The first cable 60 and the second cable 65 are respectively formed from core wires 61 and 66 (stranded wires or a single wire) made of a material (e.g., copper or aluminum) that has conductivity and flexibility, the core wires are respectively covered by sheaths 62 and 67 formed into a tubular shape and having flexibility and insulating properties. The first cable 60 is a cable originally provided in a wiring object (e.g., an automobile or the like) configured to be connected to a power source of the wiring object. The second cable 65 is a cable additionally connected to the first cable 60. A (front) end of the second cable 65 is connected to an electronic device or an electrical device (e.g., a car navigation system).

Figure 7:
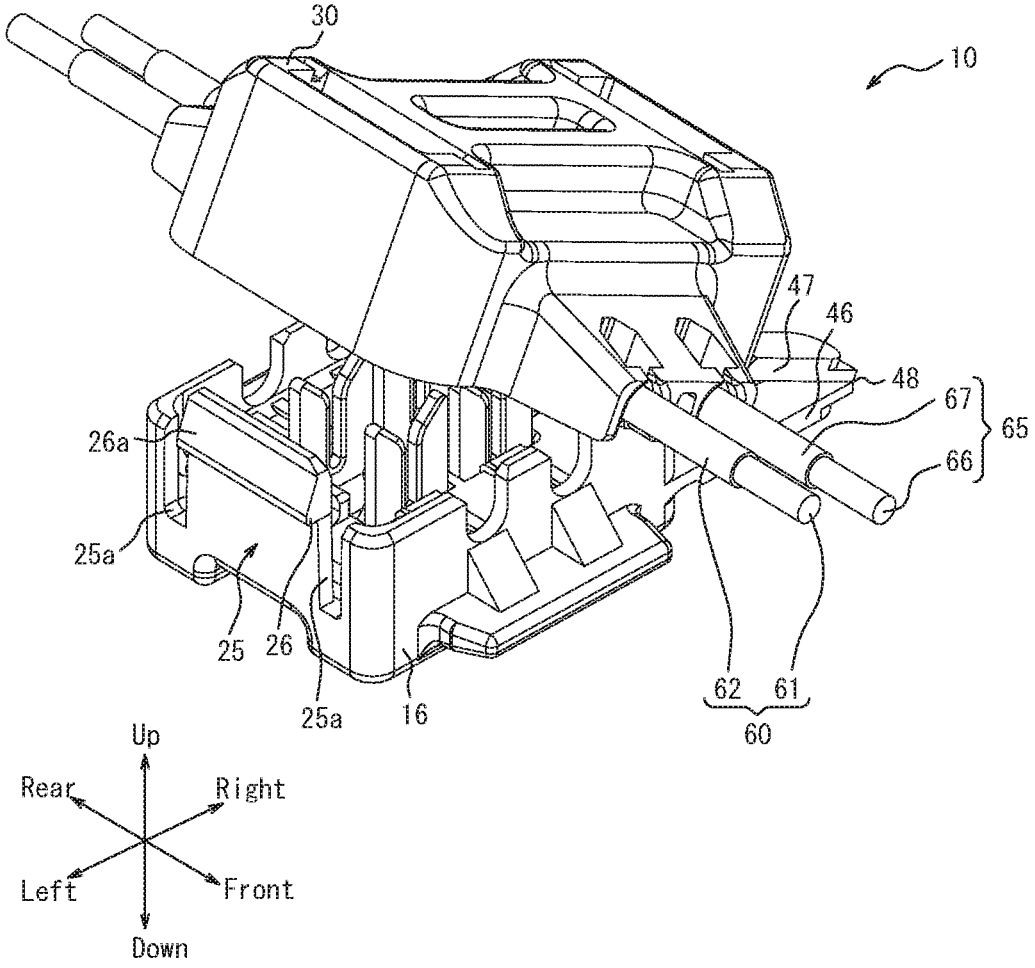
FIG. 7 is a perspective view illustrating the connector, the first cable and the second cable in transition of the insulating housing from the expanded state to a locked state.
Figure 8:
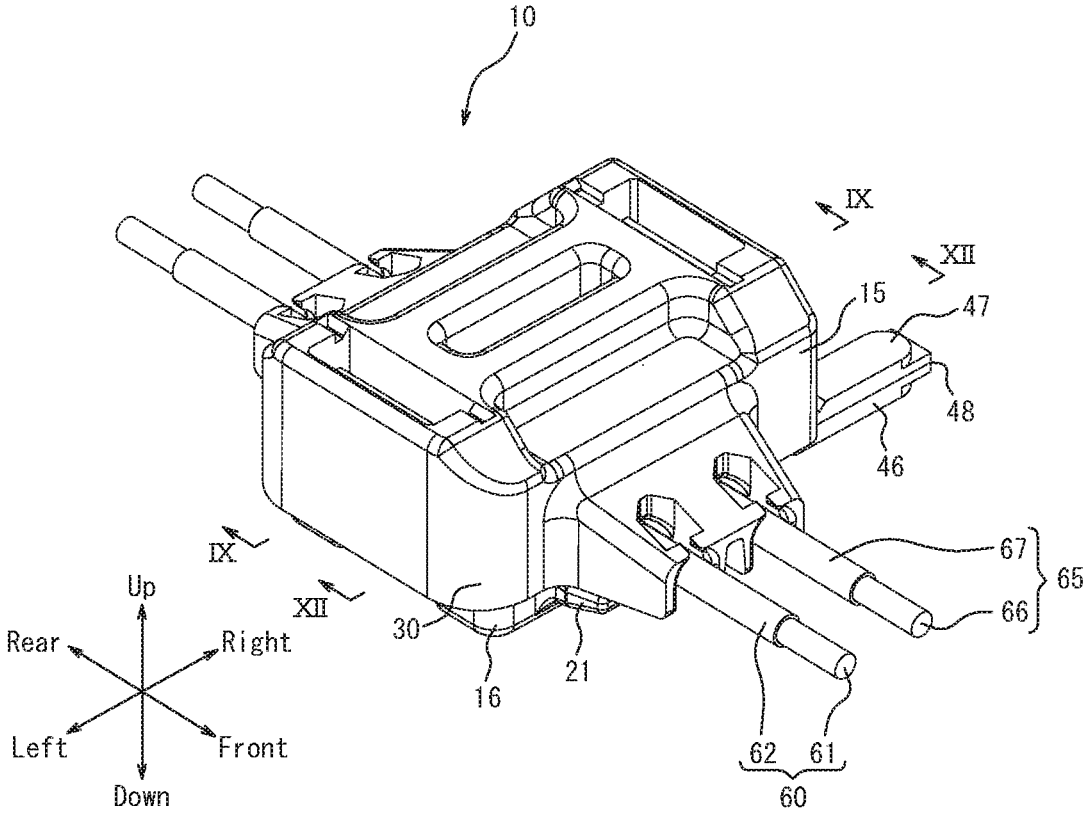
FIG. 8 is a perspective view illustrating the connector, the first cable and the second cable in which the insulating housing is in the locked state.
Figure 9:
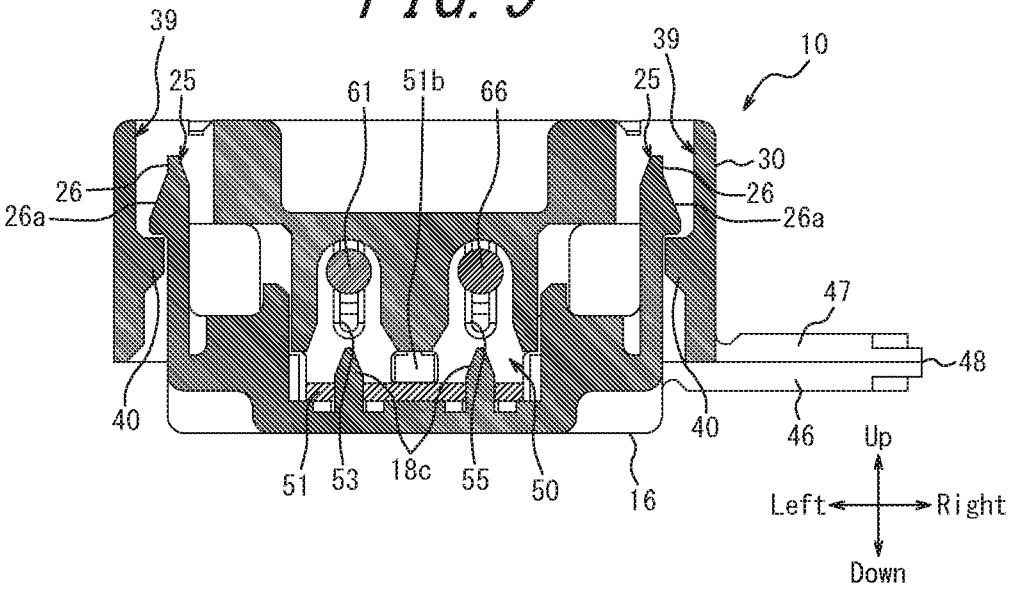
FIG. 9 is a cross-sectional view taken along arrows IX-IX of FIG. 8.

FIG. 7 is a perspective view illustrating the connector 10, the first cable 60 and the second cable 65 in transition of the insulating housing 15 from the expanded state to a locked state. FIG. 8 is a perspective view illustrating the connector 10, the first cable 60 and the second cable 65 when the insulating housing 15 is in the locked state. FIG. 9 is a cross-sectional view taken along arrows IX-IX of FIG. 8.

In order to assemble the connector 10 by integrating the insulating housing 15, the relay contact 50, the first cable 60 and the second cable 65 and electrically connecting the first cable 60 and the second cable 65, an assembling operator manually fits the lower portion of the relay contact 50 into the contact mounting groove 18 of the first split housing 16 in the expanded state illustrated in FIG. 1 and FIG. 5. In particular, the base 51 is fitted to the bottom portion of the contact mounting groove 18 in such a manner that the space 51*b* accommodates the central projection 18*b*. Each of the half portions of the first cable press-contact members 52 close to the base 51 (the lower portions in FIG. 1 and FIG. 2) is fitted to a corresponding portion of the fixing portion 18*a*. Each of the half portions of the second cable press-contact members 54 close to the base 51 is fitted to a corresponding portion of the fixing portion 18*a*. Because the pair of positioning protrusions 18*c* of the first split housing 16 is fitted into the pair of positioning holes 51*a* of the base 51 (see FIG. 2 and FIG. 9), the relay contact 50 is positioned relative to the first split housing 16. When the relay contact 50 is mounted in the first split housing 16, the first press-contact grooves 53 arranged in the front-rear direction are located on the axis extending through the pair of first cable mounting grooves 19 arranged in the front-rear direction, and the second press-contact grooves 55 arranged in the front-rear direction are located on the axis extending through the pair of second cable mounting grooves 20 arranged in the front-rear direction.

The assembling operator manually pushes the first cable 60 and the second cable 65 in a manner overcoming the resistance of the retainer protrusions 35*c* and 36*c* arranged in the front-rear direction and the retainer projections 35*d* and 36*d* arranged in the front-rear direction (see FIG. 1). At this time, the pair of protruding members 37*a*, the pair of protruding members 38*a*, the pair of protruding members 37*b* and the pair of protruding members 38*b* are bent against the elastic force in such a manner as to widen the space between the pair of retainer protrusions 35*c*, the space between the pair of retainer protrusions 36*c*, the space between the pair of retainer protrusions 35*d* and the space between the pair of retainer protrusions 36*d*, respectively. When the first cable 60 and second cable 65 are pushed into the first cable holding grooves 35*a* and 36*a* and the second cable holding grooves 35*b* and 36*b*, respectively, the space between the retainer protrusions 35*c*, the space between the retainer protrusions 36*c*, the space between the retainer protrusions 35*d*, and the space between the retainer protrusions 36*d* are narrowed. In this manner, the first cable 60 is clamped between the bottom of the first cable holding grooves 35*a* and 36*a* and the retainer protrusions 35*c* and 36*c*, and the second cable 65 is clamped between the bottom of the second cable holding grooves 35*b* and 36*b* and the retainer protrusions 35*d* and 36*d*. This enables the first cable 60 and the second cable 65 to move in the cable extending direction in a resisting manner. Thus, positions of the first cable 60 and the second cable 65 can be adjusted in the extending directions thereof relative to the connector 10 in the expanded state illustrated in FIG. 1 and FIG. 2. Upon application of a force acting to remove the first cable 60 from the first cable holding grooves 35*a* and 36*a* or a force acting to remove the second cable 65 from the second cable holding grooves 35*b* and 36*b*, the corresponding one of first cable 60 and the second cable 65 receives a resisting force inhibiting the removal thereof. Therefore, even when the connector 10 is flipped upside down, the first cable 60 and the second cable 65 do not easily fall out of the first cable holding grooves 35*a* and 36*a* and the second cable holding grooves 35*b* and 36*b*, respectively. The first cable 60 and the second cable 65 can be removed from the first cable holding grooves 35*a* and 36*a* and the second cable holding grooves 35*b* and 36*b*, respectively, upon application of an urging force of a certain strength or greater. This facilitates replacement of the connector 10 and changes of the first cable 60 and the second cable 65 to be mounted in or dismounted from the connector 10.

In a state in which the first cable 60 and the second cable 65 are arranged in the right-left direction and fitted to the first cable holding grooves 35*a* and 36*a* and the second holding grooves 35*b* and 36*b*, respectively, the second split housing 30 (the pair of second connecting portions 47 arranged in the front-rear direction) is rotated toward the first split housing 16 (the pair of first connecting portions 46 arranged in the front-rear direction) in a manner pivoting around the fold-facilitating portions 48 arranged in the front-rear direction. This causes each of the second locking protrusions 40 of the first split housing 16 to contact a corresponding one of the inclined surfaces 26*a* of the first locking protrusions 26. When the second split housing 30 is further rotated, each of the second locking protrusions 40 slides downward on a corresponding one of the inclined surfaces 26*a*, and the first locking protrusions 26 are elastically deformed inward into the first split housing 16. The second pressing groove 32*b* of the cable pressing protrusion 32 located on the side close to the second connecting portion 47 slightly pushes the central portion of the second cable 65 toward the bottom (in the downward direction) of the second press-contact groove 55. This moves the central portion of the second cable 65 into the space between each of the pair of second cable press-contact members 54 arranged in the front-rear direction.

The assembling operator manually rotates the second split housing 30 further toward the first split housing 16 in a manner pivoting around the fold-facilitating portions 48 arranged in the front-rear direction. The first pressing groove 32*a* of the cable pressing protrusion 23 located on a side remote from the second connecting portions 47 pushes the central portion of the first cable 60 against the top end portions 52*a* of the first cable press-contact members 52 in the extending direction of the first press-contact grooves 53 or in a direction close thereto. In this manner, the first cable 60 is clamped by the top end portions 52*a* and the cable pressing protrusion 32.

After the first cable 60 and the second cable 65 are placed on the top end portion 52*a* and the top end portion 54*a*, respectively, of the relay contact 50, the first split housing 16 and the second split housing 30 are pushed together in substantially parallel directions bringing them close to each other by a generic tool (e.g., pliers), which is not illustrated. Each of the second locking protrusions 40 is engaged with a corresponding one of the first locking protrusions 26. Each of the projection walls 41 of the second locking portion 39 is fitted into a corresponding one of the recesses 25*a*. In this manner, the first split housing 16 is accommodated in the second split housing 30, and the first locking portions 25 and the second locking portions 39 are engaged with each other inside the first split housing 16 and the second split housing 30 fitted together.

The cable pressing protrusion 32 further pushes the central portions of the first cable 60 and the second cable 65 deep into (toward the bottoms of) the first press-contact groove 53 and the second press-contact groove 55, respectively. This moves the first cable 60 substantially to the central portions of the first press-contact grooves 53 from the top end portions 52*a*, and the second cable 65 substantially to the central portions of the second press-contact grooves 55 from the top end portions 54*a*. At this time, the first cable 60 and the second cable 65 are pressed by the first pressing groove 32*a* and the second pressing groove 32*b*, respectively, of the cable pressing protrusion 32 in directions substantially parallel to each other in the up-down direction (i.e., the extending directions of the first press-contact groove 53 and the second press-contact groove 55). Thus, the inner surfaces (right and left surfaces) of the first press-contact groove 53 cut through the right and left side portions of the sheath 62 of the first cable 60, and the inner surfaces (right and left surfaces) of the second press-contact grooves 55 cut through the right and left side portions of the sheath 67 of the second cable 65. In this manner, when the insulating housing 15 is held in a closed state, the inner surfaces (a pair of surfaces opposing each other) of the first press-contact grooves 53 evenly and reliably contact (press contact) both side portions of the core wire 61. Also, the inner surfaces (a pair of surfaces opposing each other) of the second press-contact grooves 55 evenly and reliably contact (press contact) both side portions of the core wire 66. Consequently, the core wire 61 of the first cable 60 and the core wire 66 of the second cable 65 are electrically connected to each other via the relay contact 50 within the connector 10.

Because the side portions of the core wire 61 and the side portions of the core wire 66 are not clamped in an excessively strong manner by the inner surfaces of the first press-contact grooves 53 and the inner surfaces of the second press-contact grooves 55, parts of the core wire 61 and the core wire 66 are not cut by the first press-contact grooves 53 and the second press-contact grooves 55, respectively. Thus, the core wires 61 and 66 maintain the respective mechanical strengths, thereby reducing the likelihood that the core wires 61 and 66 are completely severed by tensile forces applied to the first cable 60 and the second cable 65. This can improve reliable contact between each of the first cable 60 and the second cable 65 and the relay contact 50.

In a state in which the first split housing 16 and the second split housing 30 are closed (fitted together) and held (locked), the opposing surface 21*a* of the cover portion 21 of the first split housing 16 partially closes the openings (the top openings in FIG. 4) of the first cable holding groove 35*a* and the second cable holding groove 35*b*, and the opposing surface 22*a* of the cover portion 22 of the first split housing 16 partially closes the openings of the first cable holding groove 36*a* and the second cable holding groove 36*b*. The first cable 60 is clamped in the up-down direction by the pair of inclined surfaces 19*a* of the first split housing 16 and the corresponding inclined surfaces 35*e* and 36*e* of the second split housing 30. The second cable 65 is clamped in the up-down direction by the pair of inclined surfaces 20*a* of the first split housing 16 and the corresponding inclined surfaces 35*f* and 36*f* of the second split housing 30.

Hereinafter, the connector 10 in a state loaded with fillers 70 will be mainly described. The fillers 70 (a first filler 70*a* and a second filler 70*b*) are provided in the first split housing 16 and the second split housing 30, respectively. The first filler 70*a* and the second filler 70*b* may be combined together or may be stuck to each other to form a bonded surface when the first split housing 16 and the second split housing 30 are fitted together. The fillers 70 may be any appropriate material including a waterproof gel, a UV curing resin, and an adhesive that has a combining property or a sticking property.

Figure 10:
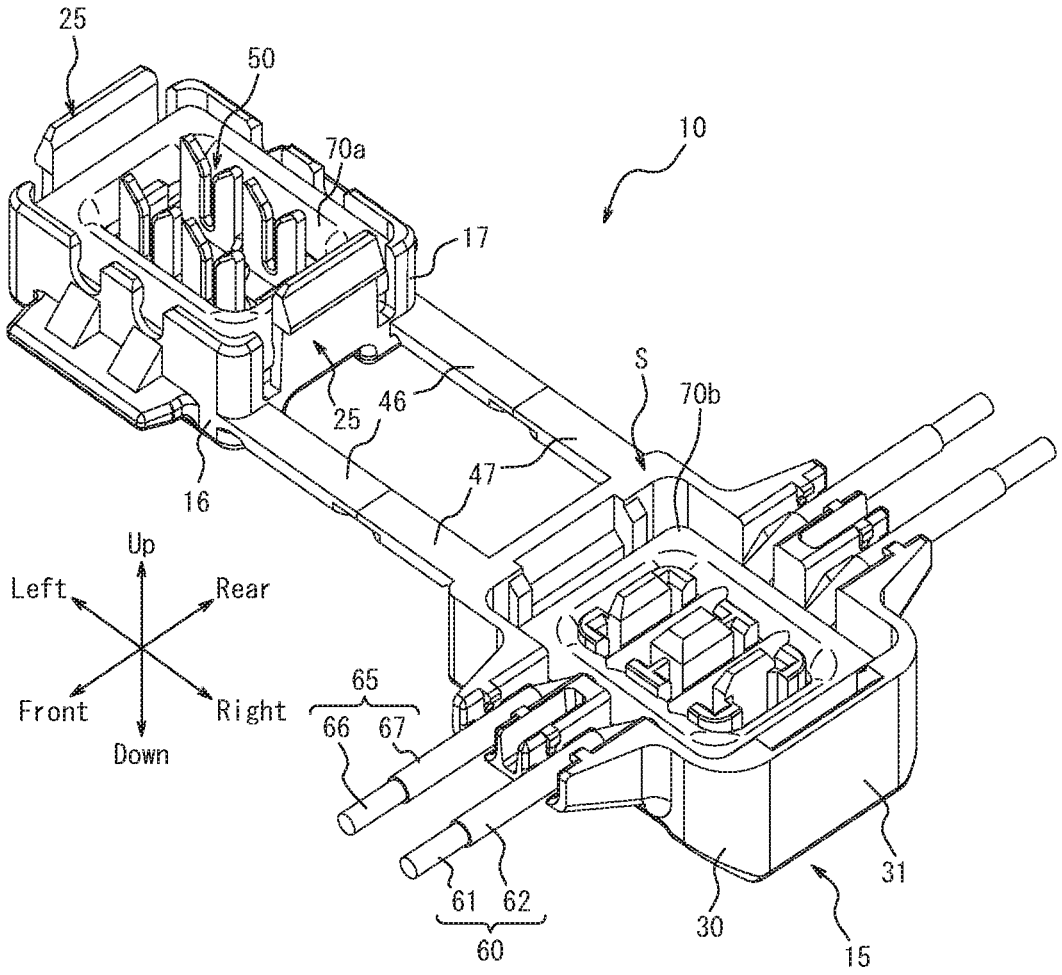
FIG. 10 is a perspective view of the insulating housing in an expanded state loaded with a filler.
Figure 11:
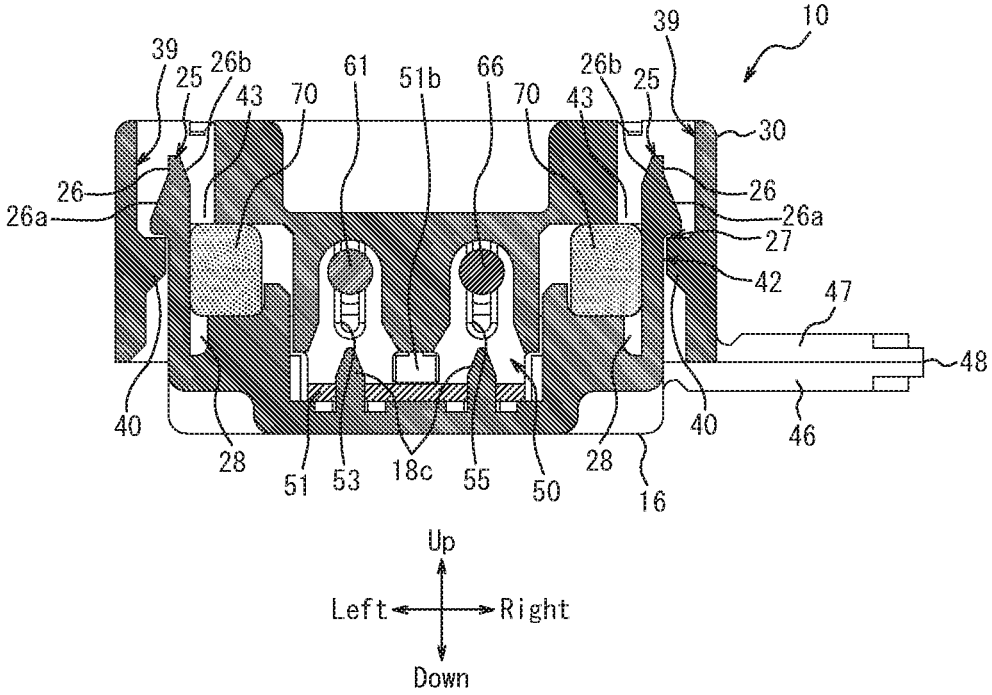
FIG. 11 is a cross-sectional view illustrating the locked state of the connector loaded with a filler corresponding to FIG. 9.
Figure 12:
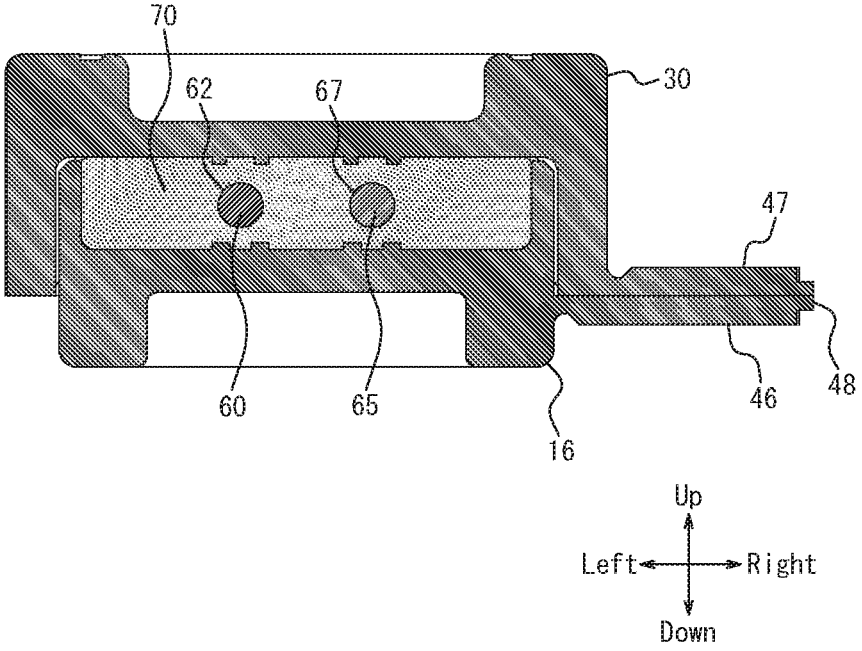
FIG. 12 is a cross-sectional view illustrating the locked state of the connector loaded with a filler taken along arrows XII-XII of FIG. 8.

FIG. 10 is a perspective view illustrating the insulating housing 15 loaded with fillers 70 in the expanded state. FIG. 11 is a cross-sectional view illustrating the connector 10 loaded with the filler 70 in the locked state corresponding to FIG. 9. FIG. 12 is a cross-sectional view illustrating the connector loaded with the fillers 70 in the locked state taken along arrows XII-XII of FIG. 8.

In an embodiment, the fillers 70 are placed on the inner peripheral first opposing surface 17*b* of the first split housing 16 and the inner peripheral second opposing surface 31*b* of the second split housing 30, as illustrated in FIG. 10.

The first filler 70*a* placed on the inner peripheral first opposing surface 17*b* of the first split housing 16 includes a bottom surface having a planar shape in substantial conformance with the inner peripheral first opposing surface 17*b*, and has a rectangular tubular shape surrounding the relay contact 50. The height of this first filler 70*a* is determined such that the first filler 70*a* and the second filler 70*b* are combined or stuck to each other when the first split housing 16 and the second split housing 30 are fitted together.

The first filler 70*a* is located inside of the upper end (the top end of the fitting side) of a corresponding first split housing 16 in a state before the first split housing 16 and the second split housing 30 are fitted together. The first filler 70*a* is located inside of the top ends of the first locking portions 25 in the first split housing 16. In other words, the top surface of the first filler 70*a* is located lower than the upper ends of the first locking portions 25. In the first split housing 16, the first filler 70*a* is located inside of the end surface, in particular the top surface of the fitting side of the outer peripheral wall 17. The top surface of the first filler 70*a* is located lower than the top surface of the outer peripheral wall 17.

The second filler 70*b* placed on the inner peripheral second opposing surface 31*b* of the second split housing 30 includes a bottom surface having a planar shape in substantial conformance with the inner peripheral second opposing surface 31*b*, and has a rectangular tubular shape surrounding the cable pressing protrusion 32. The height of the second filler 70*b* is determined such that the first filler 70*a* and the second filler 70*b* are combined or stuck to each other when the first split housing 16 and the second split housing 30 are fitted together.

The second filler 70*b* is located inside of the upper end (the top end of the fitting side) of a corresponding second split housing 30 in a state before the first split housing 16 and the second split housing 30 are fitted together. The second filler 70*b* is located inside of the top surface of the outer peripheral wall 31 constituting a part of a plane S. The top surface of the second filler 70*b* is located lower than the top surface of the outer peripheral wall 31.

When the connector 10 is transitioned to the locked state from the expanded state illustrated in FIG. 10, the entire interior of the first split housing 16 and the entire interior of the second split housing 30 fitted together is loaded with the fillers 70 as illustrated in FIG. 11. In particular, when the first split housing 16 and the second split housing 30 are brought into the locked state, the fillers 70 closely contact the inner peripheral first opposing surface 17*b* and the inner peripheral second opposing surface 31*b* and thus surround the relay contact 50.

In the locked state, the first filler 70*a* and the second filler 70*b* are crushed to each other and are brought into a compressed state once, thus are closely contact to each other.

In this context, when the filler 70 is made of a material having a combining property, the first filler 70*a* and the second filler 70*b* are integrated through chemical reaction such as hydrogen bonding. When the filler 70 is made of a material having a sticking property, the first filler 70*a* and the second filler 70*b* form a bonding surface such that they are stuck to each other. In this manner, the fillers 70 seal around the relay contact 50.

In the locked state, the first cable 60 and the second cable 65 extend outward from the relay contact arranged inside the filler 70. That is, the first cable 60 and the second cable 65 extend outward from the press-contact portion of the relay contact 50 along the front-rear direction.

The fillers 70 surround the surface of the sheath 62 of the first cable 60 and the surface of the sheath 67 of the second cable 65 in a closely contact manner without interrupting electrical connection with the relay contact 50. As illustrated in FIG. 12, when the first split housing 16 and the second split housing 30 are fitted together, the first cable 60 and the second cable 65 are arranged inside the first filler 70*a* and the second filler 70*b*, respectively, in a cross-sectional view along the fitting direction, that is, the up-down direction.

The first split housing 16 and the second split housing 30 include a pair of spaces 28 and a pair of spaces 43, respectively, for accommodating excessive portions of the fillers 70 (FIG. 11). In a state in which the first split housing 16 and the second split housing 30 are fitted together, the spaces 28 and the spaces 43 extend along the inner surfaces of the pair of first locking portions 25, and the spaces 28 are located under the fillers 70 while the spaces 43 are located above the fillers 70. In this manner, the spaces 28 and the spaces 43 can store the excessive portions of the fillers 70 in the locked state. Consequently, the connector 10 can accommodate a difference between pressing forces applied to the first cable 60 and the second cable 65.

The fillers 70 abut the inner surfaces of the pair of first locking portions 25 of the first split housing 16. Each of the engaging surfaces 27 of the first locking protrusion 26 and the second locking protrusion 40 is located, with respect to the up-down direction thereof, within the up-down direction width of the fillers 70, as illustrated in FIG. 11. When the first split housing 16 and the second split housing 30 are fitted together, the surface of the second locking protrusion 40 abuts the outer surface of the first locking portion 25. Each of abutment surfaces 42 thus formed is substantially parallel to the inner surface of the first locking portion 25 abutting the filler 70.

With the fillers 70 configured as described above, the connector 10 can effectively prevent foreign matter such as water or dust from entering from outside.

Because the fillers 70 and the relay contact 50 are located inside of the top end of the fitting side of the corresponding first split housing 16 and the second split housing 30, the connector 10 can prevent the fillers 70 and the relay contact 50 from contacting an external component even during work or transportation. Because the relay contact 50 is located inside, the connector 10 can prevent damage to the relay contact 50 and to the external component due to contact therebetween. In this manner, the connector 10 can protect the relay contact 50 and external components in an appropriate manner.

Because the fillers 70 are located inside of the top surfaces of the outer peripheral walls 17 and 31, the connector 10 can prevent contact with external components or foreign matter. Because both of the first filler 70*a* and the second filler 70*b* are located inside, the connector 10 can protect two fillers 70 required to obtain sufficient water-proof property in an appropriate manner. In this manner, the connector 10 prevents foreign matters such as water, dust or oil from attaching to the fillers 70 and change in property of fillers 70 due to foreign matters can be prevented. This enables the connector 10 to maintain a certain combining force or sticking force of the first filler 70*a* and the second filler 70*b*, and as a result an appropriate water-proof property can be achieved.

Besides the foregoing arrangement of the fillers 70 and the relay contact 50, the configuration of the insulating housing 15 illustrated in FIG. 5 facilitates packing of the connector 10. Placing the fillers 70 and the relay contact 50 inside prevents contact with the packaging material. In this manner the operator can efficiently pack the connector 10. In the case in which light such as sunlight affects the physical properties of the filler 70, the filler 70 is needed to be prevented from being exposed to external light during transportation. Thus, the connector 10 is packed with its fitting surface facing the bottom surface of the packaging material, for example. In this case, the foregoing ease of packing is more noticeable. In particular, because the connector 10 can be packaged with the plane S conformed to the bottom surface of the packaging material, the connector 10 can be packed more easily. In this case, the first split housing 16 is accommodated in a recess provided at a position one step lower than the bottom surface of the packaging material with the plane S conformed to the bottom surface of the packaging material, and as a result the entire connector 10 is packed in an appropriate manner.

As described above, the connector 10 can obtain a sufficient waterproof property and is excellent in workability as well.

Because the fillers 70 closely contact the first cable 60 and the second cable 65, even if the first cable 60 and the second cable 65 are shaken and bent by an external force applied to the outside of the connector 10, transmission of action or stress caused by the bent to the press-contact portion with the relay contact 50 can be suppressed. Consequently reliable contact can be maintained.

When the filler 70 abuts the inner surfaces of the pair of first locking portions 25, the first locking portions 25 having resiliency are elastically deformed outward by an elastic force acting from the inside to the outside caused by the expansion or swelling of the filler 70. Because the connector 10 includes the locking portions formed therein, the connector 10 enables further stronger engagement between the first locking portion 25 and the second locking portion 39 by their outward elastic deformation. In particular, because the engaging surfaces 27 of the first locking protrusions 26 and the second locking protrusions 40 are located within the up-down-direction width of the inner surface of the first locking portion 25 abutting the filler 70, an expansion force or the like of the filler 70 is efficiently converted into an engaging force. When the abutment surfaces 42 are substantially parallel to the inner surfaces of the pair of first locking portions 25 abutting the filler 70, the expansion force and the like of the filler 70 is transmitted to the surfaces of the first locking portion 25 and the second locking protrusion 40 in a direction substantially perpendicular thereto. This enables further efficient conversion of the expansion force or the like of the filler 70 into an engaging force. Consequently, the connector 10 can further strengthen the close contact between the first split housing 16 and the second split housing 30. In this manner, even in a state in which an elastic force acts from the inside to the outside, the connector 10 can inhibit opening of the first split housing 16 and the second split housing 30. Consequently, the connector 10 can maintain the waterproof property. Although the above described effect is demonstrated at a room temperature, the effect becomes more noticeable when expansion of the filler 70 is increased at high temperature.

When the fillers 70 have also high viscosity, the connector 10 can further suppress the opening between the first split housing 16 and the second split housing 30. When the fillers 70 are loaded to each inner surfaces of the first split housing 16 and the second split housing 30, the fillers 70 stick to each other in the locked state. This sticking force acts as a force resisting against the opening of the first split housing 16 and the second split housing 30 fitted together.

Because the connector 10 includes the locking mechanism inside the first split housing 16 and the second split housing 30 fitted together, the outer peripheral wall 31 can be formed in a substantially planar shape with less unevenness or through holes. This enables the connector 10 to have an improved waterproof property and to prevent other foreign matters such as dust and oil from entering from outside.

When the pair of first locking protrusions 26 extending in one direction and the pair of second locking protrusions 40 extending in the same direction are engaged with each other, and the engaging surfaces 27 form flat surfaces extending in the same direction, the connector 10 can increase an area of the engaging surfaces 27 and thus strengthen the engagement. Because the engaging surfaces 27 in the connector 10 are substantially horizontal as illustrated in FIG. 11, the engaging force can be easily transmitted between the first locking protrusion 26 and the second locking protrusion 40. In this manner, the first locking protrusion 26 and the second locking protrusion 40 of the connector 10 can have larger widths than those of conventional locking portions formed externally. This further increases a locking force and strengthens the locking. Because the strengths of the first locking portion 25 and the second locking portion 39 themselves are also increased, the connector 10 can inhibit damages to the locking portions.

Because the first locking portion 25 includes the inclined surface 26*b*, the connector 10 can prevent the top end of the first locking portion 25 from being pushed into or scraping the fillers 70 when the first split housing 16 and the second split housing 30 are fitted together.

It will be apparent to those skilled in the art that this disclosure may be realized in forms other than the embodiment described above, without departing from the spirit and the fundamental characteristics of the disclosure. Accordingly, the foregoing description is merely illustrative and not limiting in any manner. The scope of this disclosure is defined by the appended claims, not by the foregoing description. Among all modifications, those within a range of the equivalent to the present disclosure shall be considered as being included in this disclosure.

Figure 13:
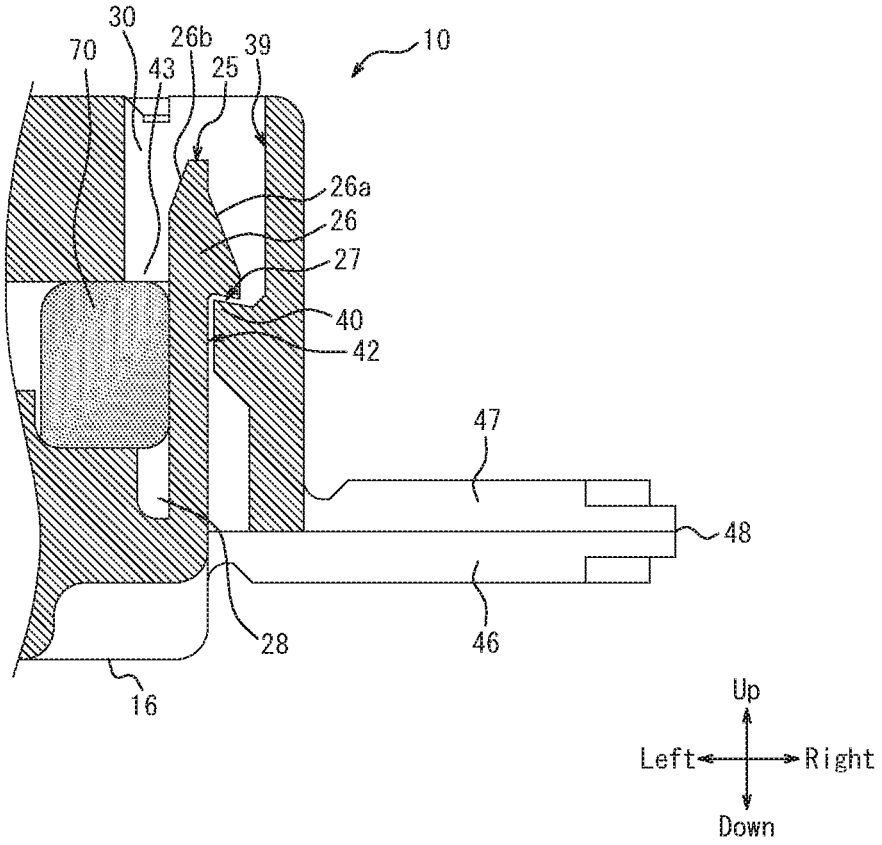
FIG. 13 is an enlarged cross-sectional view of an engaging portion of a first locking portion and a second locking portion according to a variation example corresponding to FIG. 11.

FIG. 13 is an enlarged cross-sectional view illustrating an engaging portion between the first locking portion 25 and the second locking portion 39 corresponding to FIG. 11 according to a variation. In the above embodiment, each of the engaging surfaces 27 between the first locking protrusion 26 and the second locking protrusion 40 is a horizontal flat surface extending in the front-rear direction, as illustrated in FIG. 11. However, this is not restrictive. For example, each of the engaging surfaces 27 may be inclined downward toward the outside from the inside of the first split housing 16 and the second split housing 30 fitted together, as illustrated in FIG. 13. This cross-sectional shape of the connector 10 can further reduce the likelihood of disengagement.

In an embodiment, although the first locking portions 25 are formed in the first split housing 16 and the second locking portions 39 are formed in the second split housing 30, this is not restrictive. The first locking portions 25 having resiliency may be formed in the second split housing 30 that does not include the relay contacts 50. The second locking portions 39 may be formed in the first split housing 16 that includes the relay contact 50. The positions of the first locking portions 25 and the second locking portions 39 in the first split housing 16 and the second split housing 30 are not limited to the above description. The first locking portions 25 and the second locking portions 39 may be formed in any position as long as the first split housing 16 and the second split housing 30 can be fitted together and the locked state can be secured.

In the embodiment, the first locking portions 25 and the second locking portions 39 include the first locking protrusions 26 and the second locking protrusions 40, respectively, which engage with each other and function as locking means. However, this is not restrictive. The first locking portions 25 and the second locking portions 39 may have any locking means.

In the embodiment, the pair of retainer protrusions 35*c* and the pair of retainer protrusions 36*c* configured to prevent the first cable 60 from coming off are provided to the first cable holding grooves 35*a* and groove 36*a*, respectively, and the pair of retainer protrusions 35*d* and the pair of retainer protrusions 36*d* configured to prevent the second cable 65 from coming off are provided to the second cable holding groove 35*b* and 36*b*, respectively. The retainer protrusions may be provided to each of the first pressing groove 32*a* and the second pressing groove 32*b* of the cable pressing protrusion 32.

Although the relay contact 50 is configured to clamp the second cable 65, the relay contact 50 may be configured to crimp the second cable 65. In this case, the second cable 65 is connected in a crimped manner to the relay contact 50 in advance and, in this state, the relay contact 50 is mounted in the first split housing 16. In this embodiment, cable crimp terminals are formed in place of one of the pair of first press-contact grooves 53 and the pair of second press-contact grooves 55 of the relay contact 50. The second split housing 30 is provided with the cable supporting arm 35 or 36 corresponding to the remaining one of the press-contact grooves.

The connector 10 may connect three or more cables together that are arranged in a direction orthogonal to or substantially orthogonal to the extending direction of the portions of the cables supported by the connector 10. In this case, a relay contact may include a set of three or more press-contact grooves (arranged in the right-left direction). A plurality of relay contacts may include the respective press-contact grooves. At least one of the relay contacts includes two or more pairs of press-contact grooves, each of which is configured to clamp a cable (a core wire).

In the above description, the first split housing 16 corresponds to the first fitting object and the second split housing 30 corresponds to the second fitting object. However, this is not restrictive, and the relationship may be opposite.

In the above description, the first split housing 16 including the relay contact 50 protrudes above the plane S and the second split housing 30 protrudes below the plane S. However, this is not restrictive, and the first split housing 16 including the relay contact 50 protrudes below the plane S and the second split housing 30 protrudes above the plane S.

In the above description, although the first split housing 16 and the second split housing 30 are loaded with the first filler 70*a* and the second filler 70*b*, respectively, this is not restrictive. The connector 10 may be configured such that only one of the first split housing 16 and the second split housing 30 has the filler 70 only if the connector 10 can obtain an appropriate waterproof property.

The connector 10 is not limited to the foregoing branch connector configured to electrically connect cables to each other by allowing press-contact grooves to clamp cable core wires. The connector 10 may be any type of connector only if a filler and a contact are located inside of a corresponding fitting object before a first fitting object and a second fitting object are fitted together.

REFERENCE SIGNS LIST

10 Connector
15 Insulating housing
16 First split housing (first fitting object)
17 Outer peripheral wall
17*a* Inner peripheral recess
17*b* Inner peripheral first opposing surface
17*c* First central recess
17*d* First central opposing surface
18 Contact mounting groove
18*a* Fixing portion
18*b* Central projection
18*c* Positioning protrusion
19 First cable mounting groove
19*a* Inclined surface
20 Second cable mounting groove
20*a* Inclined surface
21, 22 Cover portion
21*a*, 22*a* opposing surface
25 First locking portion
25*a* Recess
26 First locking protrusion
26*a*, 26*b* Inclined surface
27 Engaging surface
28 Space
30 Second split housing (second fitting object)
31 Outer peripheral wall
31*a* Inner peripheral recess
31*b* Inner peripheral second opposing surface
32 Cable pressing protrusion
32*a* First pressing groove
32*b* Second pressing groove
32*c* Central protrusion
32*d*, 32*e* Protrusion
35, 36 Cable supporting arm
35*a*, 36*a* First cable holding groove
35*b*, 36*b* Second cable holding groove
35*c*, 36*c* Retainer protrusion
35*d*, 36*d* Retainer protrusion
35*e*, 36*e* Inclined surface
35*f*, 36*f* Inclined surface
37*a*, 37*b*, 38*a*, 38*b* Protruding member
39 Second locking portion
40 Second locking protrusion
41 Projection wall
42 Abutting surface
43 Space
46 First connecting portion (connecting portion)
47 Second connecting portion (connecting portion)
48 Fold-facilitating portion
50 Relay contact (contact)
51 Base
51*a* Positioning hole
51*b* Space
52 First cable press-contact member
52*a* Top end portion
52*b* Narrow portion
53 First press-contact groove (electrically connecting portion, press-contact groove)
54 Second cable press-contact member
54*a* Top end portion
54*b* Narrow portion
55 Second press-contact groove (electrically connecting portion, press-contact groove)
60 First cable (cable)
61 Core wire
62 Sheath
65 Second cable (cable)
66 Core wire
67 Sheath
70 Filler
70*a* First filler
70*b* Second filler
S Plane

The invention claimed is:

1. A connector, comprising:

a pair of a first fitting object and a second fitting object capable of being fitted together, said first fitting object including an outer peripheral wall;

a filler provided in at least one of said first fitting object and said second fitting object; and a contact provided to at least one of said first fitting object and said second fitting object; wherein:

said filler and said contact are located, in a corresponding fitting object, inside of a top end of a fitting side of said fitting object in a state before said first fitting object and said second fitting object are fitted together; and said contact is fitted to a contact mounting groove that is recessed in said first fitting object and is, in view of said fitting side, arranged inside of said outer peripheral wall including a side wall and a locking portion in said state before said first fitting object and said second fitting object are fitted together.

2. The connector according to claim 1, wherein said filler is located, in said at least one of said fitting objects, inside of an end surface of a fitting side of said outer peripheral wall.

3. The connector according to claim 1, wherein said filler is provided in each of said first fitting object and said second fitting object, and is located, in each of said first fitting object and said second fitting object, inside of an end surface of a fitting side of said outer peripheral wall.

4. The connector according to claim 1, wherein said first fitting object and said second fitting object are connected to each other by a connecting portion;

said first fitting object or said second fitting object includes said contact having an electrically connecting portion;

said first fitting object or said second fitting object holds a cable; and said contact is included with electrically connected to said cable in a state in which said first fitting object and said second fitting object are fitted together.

5. The connector according to claim 4, wherein at least one of said cables extends outside of said contact arranged inside of said filler when said first fitting object and said second fitting object are fitted together.

6. The connector according to claim 4, wherein said electrically connecting portion is a press-contact groove;

said first fitting object or said second fitting object holds at least two of said cables; and said contact clamps core wires of said cables by said press-contact groove to electrically connect said cables to each other when said first fitting object and said second fitting object are fitted together.

7. The connector according to claim 4, wherein a top end surface of a fitting side of one of said first fitting object and said second fitting object and a surface of said connecting portion are arranged on a same plane, and another one of said fitting objects projects in a direction opposite said one of fitting objects with respect to said plane.

8. A connector, comprising:

a first fitting object and a second fitting object capable of being fitted together, said first fitting object including a first outer peripheral wall and said second fitting object including a second outer peripheral wall;

a filler provided in said first outer peripheral wall of said first fitting object and said second outer peripheral wall of said second fitting object; and a contact located in said first outer peripheral wall of said first fitting object; wherein in an expanded state where said first fitting object and said second fitting object are expanded:

said contact is surrounded by said first outer peripheral wall including a side wall and a locking portion and is located, in said first fitting object, inside of a top end of a fitting side of said locking portion that most protrudes toward said fitting side in said first fitting object;

said filler is located, in said first fitting object, inside of a top end of said fitting side of said side wall and, in said second fitting object, inside of a top end of said fitting side of said second outer peripheral wall, and is arranged around a contact mounting groove that is recessed in said first fitting object; and said contact is fitted to said contact mounting groove.

* * * * *